US009541296B2

(12) United States Patent
Huang

(10) Patent No.: US 9,541,296 B2
(45) Date of Patent: Jan. 10, 2017

(54) SOOT-EXHAUSTING DEVICE

(71) Applicant: National Taiwan University of Science and Technology, Taipei (TW)

(72) Inventor: Rong Fung Huang, Taipei (TW)

(73) Assignee: NATIONAL TAIWAN UNIVERSITY OF SCIENCE AND TECHNOLOGY, Taipei (TW)

( * ) Notice: Subject to any disclaimer, the term of this patent is extended or adjusted under 35 U.S.C. 154(b) by 271 days.

(21) Appl. No.: 14/285,153

(22) Filed: May 22, 2014

(65) Prior Publication Data

US 2015/0338107 A1 Nov. 26, 2015

(51) Int. Cl.
*F24C 15/20* (2006.01)
*B08B 15/02* (2006.01)

(52) U.S. Cl.
CPC ..... *F24C 15/2042* (2013.01); *B08B 15/023* (2013.01); *B08B 2215/003* (2013.01); *B08B 2215/006* (2013.01)

(58) Field of Classification Search
CPC ..... B08B 15/023; B08B 2215/003; B08B 2215/006; F24C 15/2042
USPC ..... 126/299 D; 454/49, 56
See application file for complete search history.

(56) References Cited

U.S. PATENT DOCUMENTS 2,702,505 A * 2/1955 Nelson ..... B08B 15/023 126/299 R
4,280,400 A * 7/1981 Longworth ..... B08B 15/023 454/57
4,550,650 A * 11/1985 Denner ..... B08B 15/023 454/57
4,677,904 A * 7/1987 Natsumeda ..... F15D 1/08 454/266
5,112,373 A * 5/1992 Pham ..... A45D 44/02 454/56
5,216,782 A * 6/1993 Schenck ..... B01L 1/00 16/194
6,428,408 B1 * 8/2002 Bell ..... B01L 1/50 454/56
6,461,233 B1 * 10/2002 Gilkison ..... B08B 15/023 454/56
2002/0108608 A1 * 8/2002 Tseng ..... F24C 15/20 126/299 D
2007/0281598 A1 * 12/2007 Huang ..... B08B 15/02 454/56
2011/0094497 A1 * 4/2011 Schrock ..... F24C 15/2028 126/299 D (Continued)

*Primary Examiner* — Avinash Savani
*Assistant Examiner* — George R Blum
(74) *Attorney, Agent, or Firm* — Muncy, Geissler, Olds & Lowe, P.C.

(57) ABSTRACT

A soot-exhausting device is provided with a left and a right upright plate. A front end of the left upright plate is bended and extended to form a first upright plate and a left deflection plate. The upper part of the free end of the left deflection plate is bended rightwardly to form a left top plate. A front end of the right upright plate is bended and extended to form a second upright plate and a right deflection plate. The upper part of the free end of the right deflection plate is bended leftwardly to form a right top plate. The bottom of the air-extraction hood is provided with a left and a right air blow groove that are respectively in elongate shape and parallel to top side of the left and the right top plate and located at the rear end of each top side.

8 Claims, 8 Drawing Sheets

(56) References Cited

U.S. PATENT DOCUMENTS

| | | | | |
|---|---|---|---|---|
| 2012/0152229 | A1* | 6/2012 | Huang | F24C 15/2028 126/299 R |
| 2012/0276830 | A1* | 11/2012 | Huang | F24F 9/00 454/49 |
| 2013/0074261 | A1* | 3/2013 | Hallman | A61G 13/0027 5/600 |
| 2014/0020673 | A1* | 1/2014 | Zank | F24C 15/2021 126/299 D |
| 2015/0338107 | A1* | 11/2015 | Huang | B08B 15/02 126/299 D |
| 2016/0161129 | A1* | 6/2016 | Huang | F24C 15/2071 126/299 D |

* cited by examiner

SOOT-EXHAUSTING DEVICE

TECHNICAL FIELD

The present invention relates to a soot-exhausting device, especially to a soot-exhausting device capable of effectively preventing the leakage of soot pollutants and suitable for factories, laboratories and kitchens.

BACKGROUND

A conventional range hood scarcely differs from a ceiling-mounted range hood in a working space. The flange of this kind of range hood may be in a flat shape, a downward arc shape, or in a box-shape, and the air-extraction opening may be in a round shape, a square shape, a rectangular shape, or in an elongate shape. When this kind of range hood draws air, the air and pollutants would flow into the space below the hood from the edge of the flange, then be drawn into the air-extraction opening, and afterwards the air and pollutants would be exhausted outside through ducts. In this case, the air flow rate at the location near the air-extraction opening is high, while the air flow rate at the location away from the air-extraction opening decreases rapidly with the increase of the distance from the air-extraction slot. The upward force of extraction would be insufficient because the upward air velocity becomes low within a short distance below the air-extraction opening so that the flow field is easily affected by drafts from people walking, fans or air conditioner operating. Under such interferences, the soot and pollutants would disperse by the interference flow.

When above range hood is used in high-temperature production or cooking processes, the speed of updraft would increase due to the large buoyant effect resulted from high temperature of fire. Under these conditions, the soot and pollutants would disperse out easily from the front, the rear, and the lateral sides of the range hood due to turbulent diffusion and expansion effect caused by the high temperature of fire. Therefore, the conventional soot-exhausting device would enhance the force of extraction to improve the extraction capacity. However, in this way, not only does the noise increase and the energy waste, but the leakage also could not be prevented completely.

As for above problems, a common improvement is shown in FIG. 8, where baffles were added respectively in the left side, right side, and the rear of the soot-exhausting device (a). However, when in implementation, the boundary layers of flow are easily departed at the front edge of both side plates (b) so as to produce a large recirculation bubble (c) respectively. Soot pollutants would be entrained and carried by the flow of this big recirculation bubble (c) to the front edge of both side plates (b) nearby and be leaked out as a result of molecular diffusion and turbulent diffusion or be swept to external environment as a result of the effect of environment interference flow. Complicated three dimension vortexes and strong turbulences would be produced at the cross of the flange (d) and the side plate (b) of the soot-exhausting device (a) as a result of the three-dimensional effect. In this case, soot pollutants would also be swept to the cross of the flange (d) and the side plate (b) of the soot-exhausting device (a) to cause leakage. For this reason, it is unable to achieve the effect of preventing leakage completely simply by adding side plates (b) respectively in the left and right side of the soot-exhausting device (a).

SUMMARY OF THE DISCLOSURE

In view of this, in order to provide a structure distinct from conventional ones and in order to improve above shortcomings, the inventor had developed the present invention after years of experiences and nonstop research and improvements.

An object of the present invention is to provide a soot-exhausting device that is provided with a first and a second upright plate and a left and a right deflection plate respectively at the front end of the left and right upright plate, so as to solve the problem of large recirculation bubble that is easily produced by the conventional soot-exhausting device, then to keep the large recirculation bubble away from the front edge of the side plates nearby to prevent the leakage of pollutants.

Another object of the present invention is to provide a soot-exhausting device that is provided with a left and a right deflection plates at the front end of the left and the right upright plates and a left and a right top plates in the upper part of the left and the right deflection plates, where the bottom of the air-extraction hood is provided with a left and a right air blow grooves, so as to solve the problem of three dimensional vortexes and strong turbulences that are produced at the cross of the flange and the side plate of the conventional soot-exhausting device, then to keep the air vortexes away from the opening in the front of the soot-exhausting device to prevent the leakage of pollutants.

In order to achieve above objects, the present invention provides a soot-exhausting device, comprising an air-extraction hood, a left upright plate and a right upright plate, where a bottom of the air-extraction hood is provided with at least one air-extraction slot and the air-extraction slot is connected to an air-extraction device for drawing air upwards; the left upright plate and the right upright plate are respectively placed below a left side and a right side of the air-extraction hood; and a space is formed between the air-extraction hood, the left upright plate and the right upright plate; wherein a side or a surface of the air-extraction hood, the left upright plate and the right upright plate that is approaching towards a user is defined as a front end, while a side or a surface of the air-extraction hood, the left upright plate and the right upright plate that is away from the user in an opposite direction is defined as a rear end; and two sides of the air-extraction hood, the left upright plate and the right upright plate are respectively defined as a left side and a right side when the user faces the air-extraction hood, left upright plate and right upright plate; the soot-exhausting device characterized in that: the front end of the left upright plate is bended and extended right-backwardly to form a left deflection plate, and the left deflection plate is vertically located in the space; a first included angle is formed between the left deflection plate and the left upright plate; and a side of the left deflection plate that is away from the front end of the left upright plate is defined as a free end of the left deflection plate, and an upper part of the free end of the left deflection plate is bended rightwardly in a direction away from the left upright plate to form a left top plate; the front end of the right upright plate is bended and extended left-backwardly to form a right deflection plate, and the right deflection plate is vertically located in the space; a second included angle is formed between the right deflection plate and the right upright plate; and a side of the right deflection plate that is away from the front end of the right upright plate is defined as a free end of the right deflection plate, and an upper part of the free end of the right deflection plate is bended leftwardly in a direction of being away from the right upright plate to form a right top plate; and the right top plate and the left top plate have a first spacing therein-between; and the bottom of the air-extraction hood is provided with a left air blow groove and a right air blow groove that are respectively in elongate shape and blow air downwardly; the left air blow groove is parallel to a top side of the left top plate and located at the rear end of the top side of the left top plate; the right air blow groove is parallel to a top side of the right top plate and located at the rear end of the top side of the right top plate; and the left air blow groove and the right air blow groove are aligned and have a second spacing therein-between; and the distance of the second spacing is shorter than the distance of the first spacing.

In implementation, the present invention further comprises a first upright plate and a second upright plate, where the first upright plate is bended and extended leftwardly from a front end of the left upright plate, while the second upright plate is bended and extended rightwardly from a front end of the right upright plate.

In implementation, the first included angle and the second included angle face backwardly respectively, and the first included angle and the second included angle are between 20 degrees to 70 degrees respectively.

In implementation, the present invention further comprises a first guiding plate and a second guiding plate, where the first guiding plate is bended leftwardly from the free end of the left deflection plate in a direction of approaching towards the left upright plate, while the second guiding plate is bended rightwardly from the free end of the right deflection plate in a direction of approaching towards the right upright plate.

In implementation, the left top plate and the right top plate are symmetrical to each other, and the left top plate has one end that is extended rightwardly while not exceeds the air-extraction slot's left edge, and the right top plate has one end that is extended leftwardly while not exceeds the air-extraction slot's right edge.

In implementation, the left top plate and the right top plate are inverted triangle plates respectively.

The following detailed description, given by way of preferred examples or embodiments, will further be understood in conjunction with the accompanying drawings and numbers.

DETAILED DESCRIPTION

Figure 1:
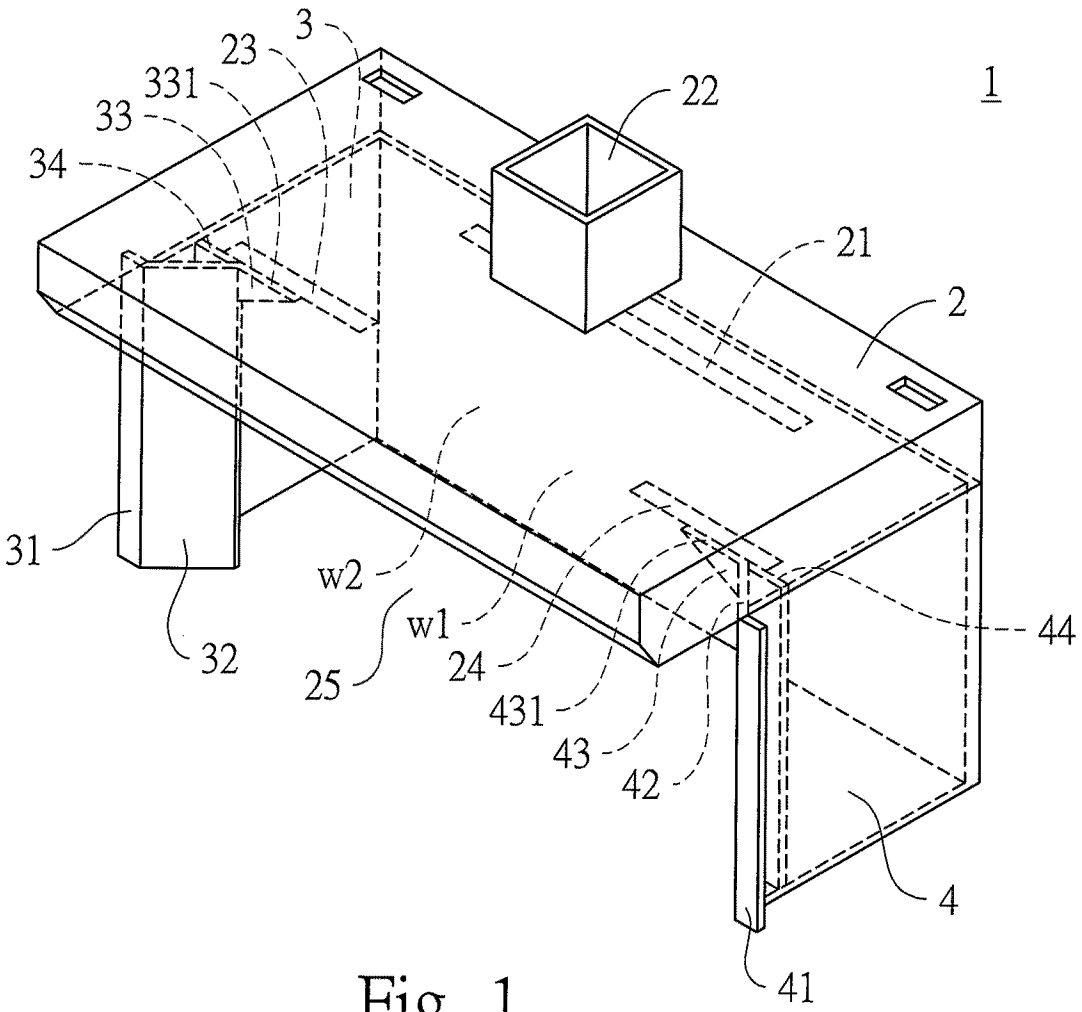
FIG. 1 is a perspective view showing a preferred embodiment of the present invention.
Figure 2:
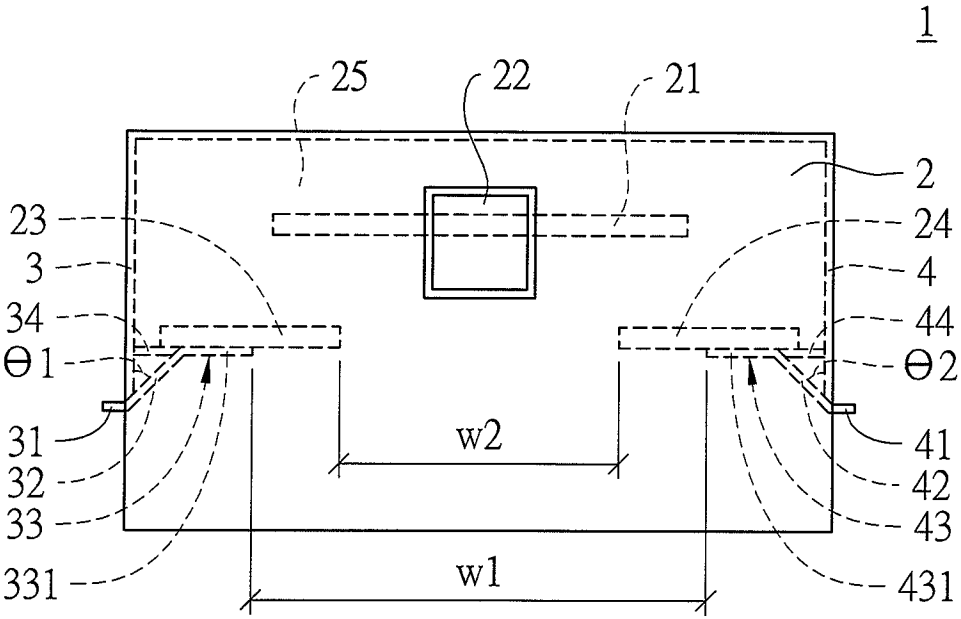
FIG. 2 is a top view showing the preferred embodiment of the present invention.
Figure 3:
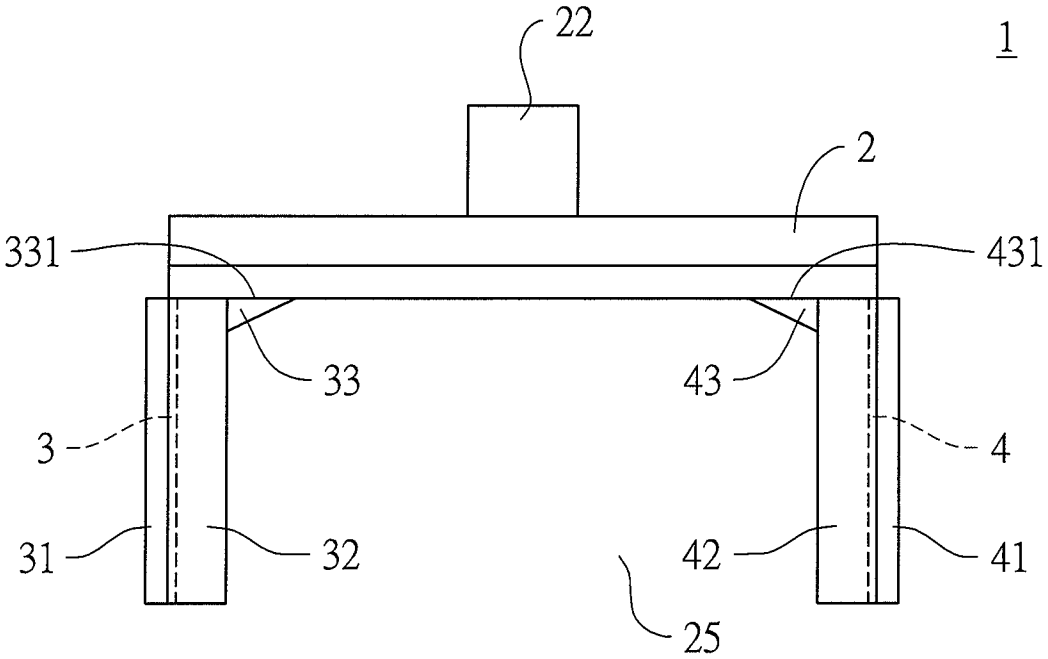
FIG. 3 is a front view showing the preferred embodiment of the present invention.

Please refer to FIGS. 1-3 showing a preferred embodiment of a soot-exhausting device 1 of the present invention, comprising an air-extraction hood 2, a left upright plate 3, a first upright plate 31, a left deflection plate 32, a left top plate 33, a first guiding plate 34, a right upright plate 4, a second upright plate 41, a right deflection plate 42, a right top plate 43, and a second guiding plate 44. A side or a surface of the air-extraction hood 2, the left upright plate 3 and the right upright plate 4 that is approaching towards a user is defined as a front end, while a side or a surface that is away from the user in an opposite direction is defined as a rear end. And a left side and a right side are defined when the user faces the air-extraction hood 2, the left upright plate 3 and the right upright plate 4.

The bottom of the air-extraction hood 2 is provided with an air-extraction slot 21 that is in elongate and rectangular shape and a long end of the elongate air-extraction slot 21 is parallel to a rear end surface of the air-extraction hood 2. In implementation, the bottom of the air-extraction hood 2 may also be provided with one or more air-extraction openings 21 in a round shape, a square shape, or in a rectangular shape. A top end of the air-extraction hood 2 is provided with an air-exhausting opening 22 that is connected to an air-extraction device, such as a blower, to draw air upwardly outside from the air-exhausting opening 22 when the air-extraction device operates. Furthermore, the bottom of the air-extraction hood 2 is provided with a left air blow groove 23 and a right air blow groove 24 that are respectively in elongate shape. The left air blow groove 23 and the right air blow groove 24 could be connected to an air-exhausting device, such as a cross flow fan, to blow air downwardly. The left air blow groove 23 is parallel to a top side 331 of the left top plate 33 and located at a rear end of the top side 331. The right air blow groove 24 is parallel to a top side 431 of the right top plate 43 and located at a rear end of the top side 431. The left air blow groove 23 and the right air blow groove 24 are aligned and have a second spacing W2 therein-between.

The left upright plate 3 and the right upright plate 4 are respectively a rectangular plate. The left upright plate 3 and the right upright plate 4 are respectively placed below the left side and the right side of the air-extraction hood 2. A space 25 is formed between the air-extraction hood 2, the left upright plate 3, and the right upright plate 4, and an opening is formed in front of the space 25.

The first upright plate 31, the left deflection plate 32, the second upright plate 41, and the right deflection plate 42 are respectively a vertical rectangular plate. In this case, the first upright plate 31 is bended and extended leftwardly from the front end of the left upright plate 3, and the second upright plate 41 is bended and extended rightwardly from the front end of the right upright plate 4. The left deflection plate 32 is bended and extended right-backwardly from the front end of the left upright plate 3 and is vertically located in the space 25, where a first included angle θ 1 is formed between the left deflection plate 32 and the left upright plate 3, and the first included angle θ 1 is between 20 degrees to 70 degrees. The right defection plate 42 and the left deflection 32 are symmetrical with each other, where the right deflection plate 42 is bended and extended left-backwardly from the front end of the right upright plate 4 and is vertically located in the space 25; and a second included angle θ 2 is formed between the right deflection plate 42 and the right upright plate 4, and the second included angle θ 2 is between 20 degrees to 70 degrees.

A side of above left deflection plate 32 that is away from the front end of the left upright plate 3 is defined as a free end of the left deflection plate 32, while a side of the right deflection plate 42 that is away from the front end of the right upright plate 4 is defined as a free end of the right deflection plate 42. The left top plate 33 is an inverted triangle plate that is formed by having an upper part of the free end of the left deflection plate 32 bended and extended rightwardly in a direction away from the left upright plate 3, while the right top plate 43 is an inverted triangle plate that is formed by having an upper part of the free end of the right deflection plate 42 bended and extended leftwardly in a direction away from the right upright plate 4. The left top plate 33 and the right top plate 43 are symmetrical with each other, where the left top plate 33 has one end that is extended rightwardly and not exceeds the air-extraction slot's 22 left edge, and the right top plate 43 has one end that is extended leftwardly and not exceeds the air-extraction slot's 22 right edge. The right top plate 43 and the left top plate 33 have a first spacing W1 therein-between, where the distance of the first spacing W1 is longer than the distance of the second spacing W2. When in implementation, the left top plate 33 and the right top plate 43 may be any plates in arch shape, rectangular shape, or in other shapes with the same flow-guiding function. The first guiding plate 34 is a plate bended leftwardly from the free end of the left deflection plate 32 in a direction of approaching towards the left upright plate 3, while the second guiding plate 44 is a plate bended rightwardly from the free end of the right deflection plate 42 in a direction of approaching towards the right upright plate 4.

When in implementation, above first upright plate 31, left deflection plate 32, left top plate 33, and first guiding plate 34 can be separate plates. However, the first upright plate 31, left deflection plate 32, left top plate 33, and first guiding plate 34 also can be formed integratedly. Similarly, the second upright plate 41, right deflection plate 42, right top plate 43, and second guiding plate 44 can be separate plates or formed integratedly.

Figure 4:
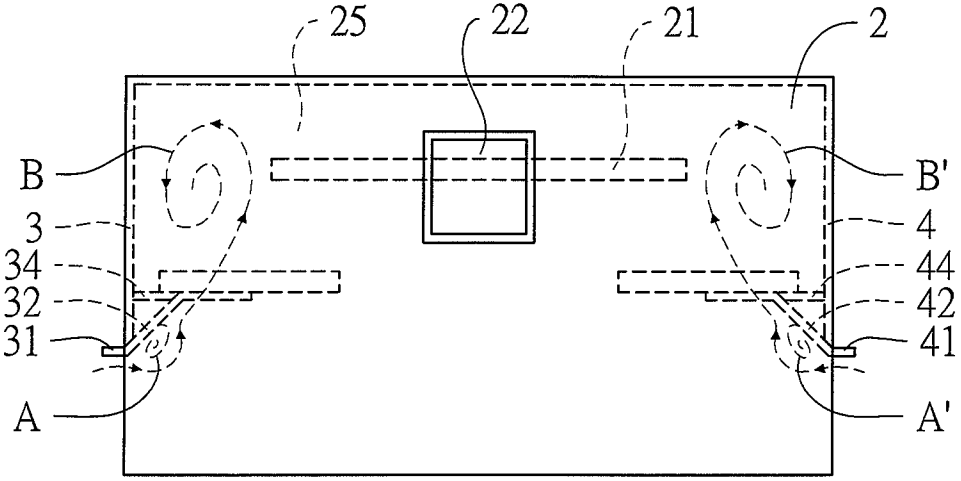
FIGS. 4-7 show the use of the preferred embodiment of the present invention.

Thereby, as shown in FIG. 4, the soot pollutants would be drawn upwardly from the air-exhausting slot 22 when the air-extraction device operates. During the air-exhausting process, when the air outside the left upright plate 3 and the right upright plate 4 is drawn into the space 25 from the location near the front end of the left upright plate 3 and the right upright plate 4 via the opening of the air-extraction hood 2, the drawn air would flow along the first upright plate 31, left deflection plate 32, second upright plate 41, and right deflection plate 42. The boundary layers of the airflow would respectively separate at the front edge of the left deflection plate 32 and the right deflection plate 42, so as to form a small recirculation bubble (A, A') respectively. At this time, by setting the length of the left deflection plate 32 and the right deflection plate 42 to be longer than the length of the small recirculation bubble (A, A') respectively, the reattached boundary layers of the airflow would flow backwardly along the left deflection plate 32 and the right deflection plate 42 at the rear part of the left deflection plate 32 and the right deflection plate 42, and then depart at the edge of the rear end of the left deflection plate 32 and the right deflection plate 42, so as to form a vortex (B, B') respectively. The two vortexes (B, B') would be formed respectively at the back of the left deflection plate 32 and the right deflection plate 42, and would be far away from the opening of space below the air-extraction hood 2. Accordingly, soot pollutants are unable to flow back along the original entrance path via the vortexes (B, B') and the leakage of soot pollutants could be prevented.

Figure 5:
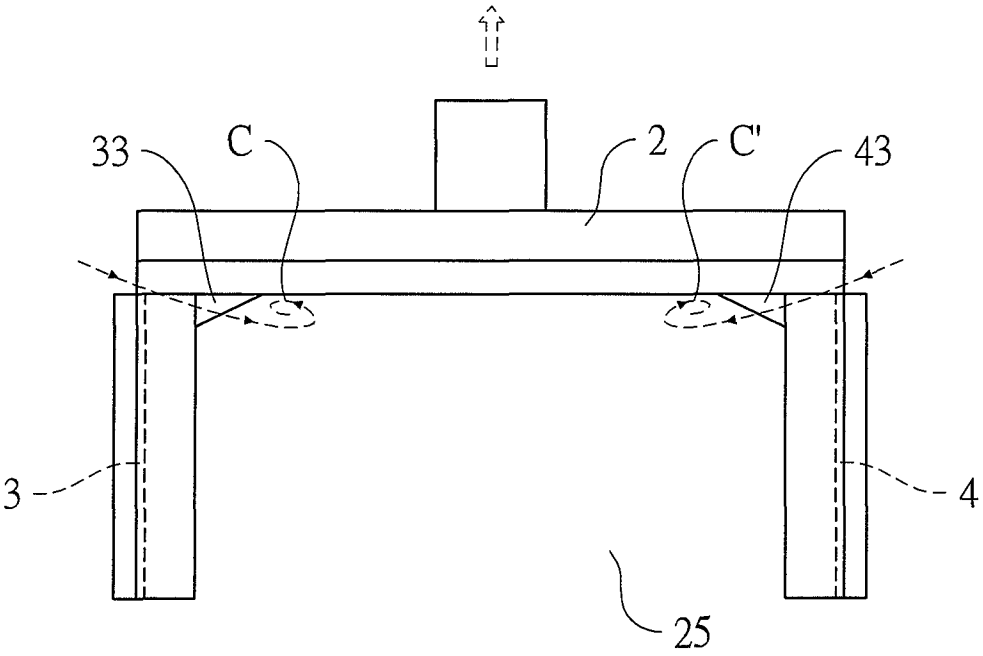
Figure 8:
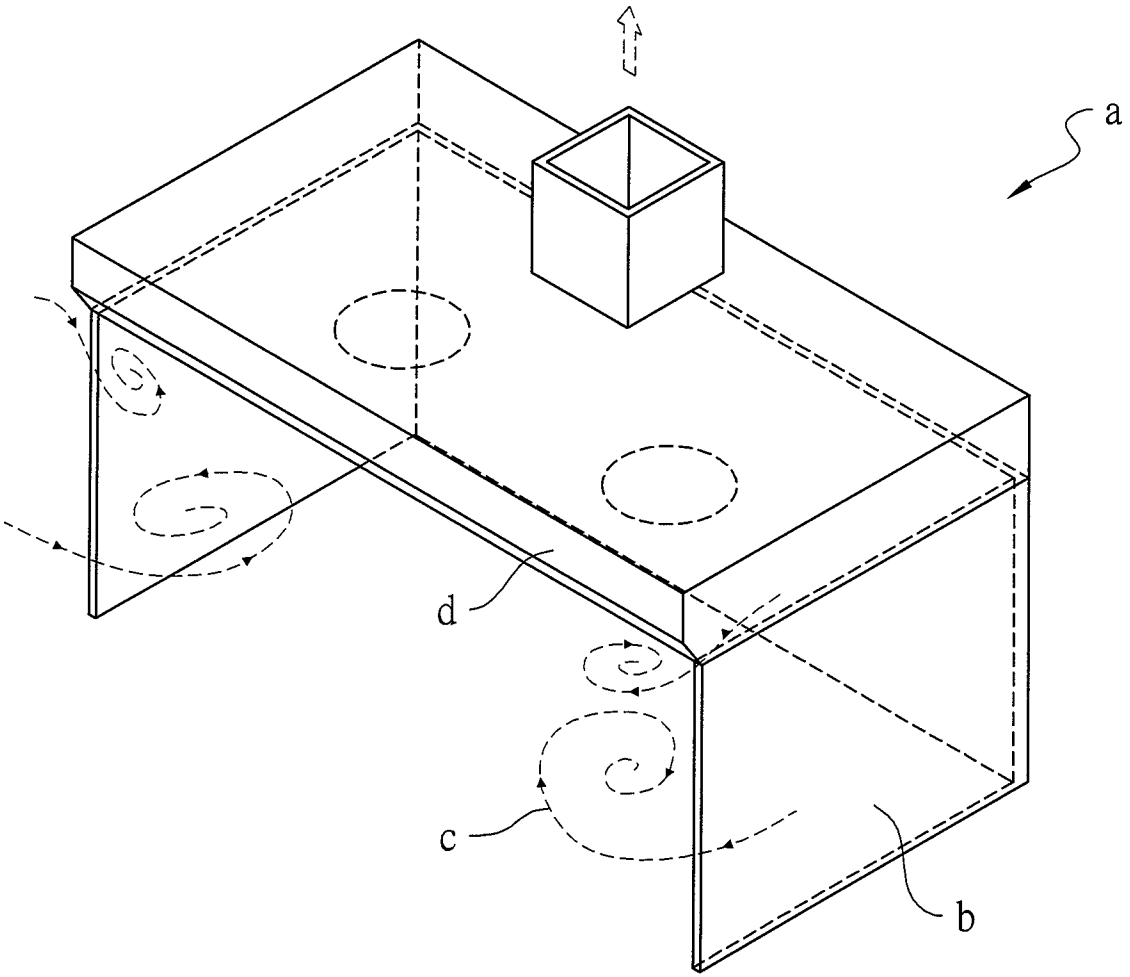
FIG. 8 shows the use of a conventional range hood.

As shown in FIG. 5, it is the state of the airflow passing by the left top plate 33 and the right top plate 43. In this case, when the airflow flows into the space 25 from the cross of the air-extraction hood 2 and the left upright plate 3 and the right upright plate 4, the recirculation bubble that is formed due to the three-dimensional effect as shown in FIG. 8 would disappear. Thereby, the airflow could flow respectively along the left top plate 33 and the right top plate 43, and depart at the edge of the rear end of the left top plate 33 and the right top plate 43, so as to form respectively a vortex (C, C'), where the vortex (C, C') is far away from the opening of the space below the air-extraction hood 2.

Figure 6:
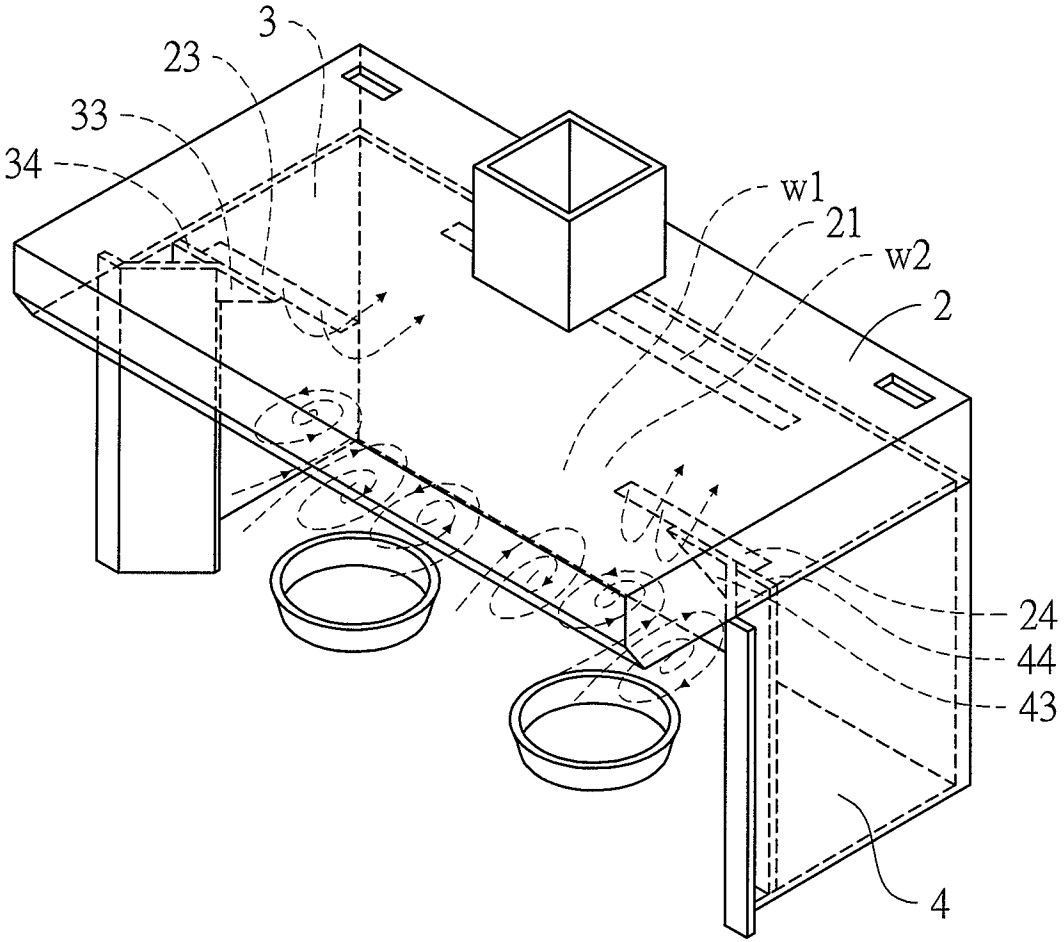
Figure 7:
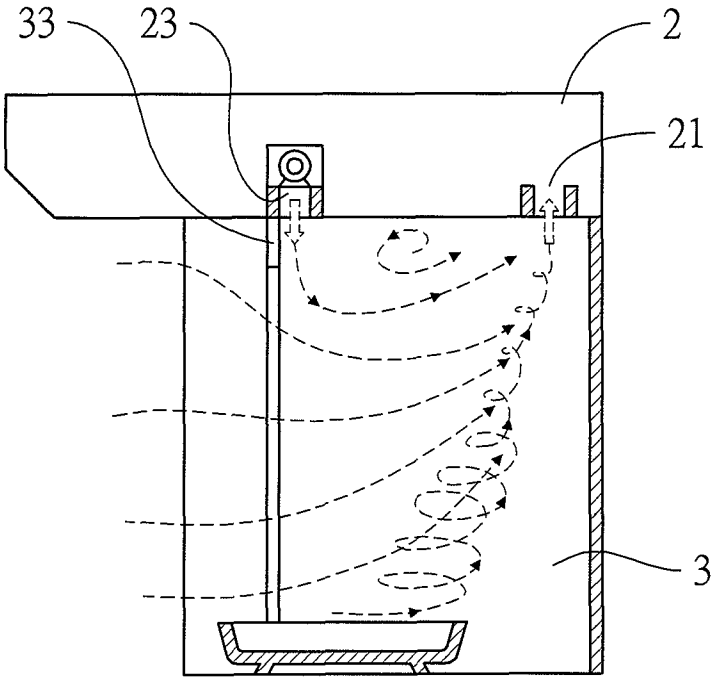

As shown in FIGS. 6 and 7, the left air blow groove 23 and the right air blow groove 24 are respectively placed at the rear end of the left top plate 33 and the right top plate 43, and the distance of the second spacing W2 is shorter than the distance of the first spacing W1. Therefore, the formed vortexes (C, C') that depart from the edge of the rear end of the left top plate 33 and the right top plate 43 would be guided into the air-extraction slot 21 by the air blown downwardly from the left air blow groove 23 and the right air blow groove 24, so as to prevent the leakage of soot pollutants from the cross of the air-extraction hood 2 and the left upright plate 3 and the right upright plate 4. In addition, owing to the guidance of the first guiding plate 34 and the second guiding plate 44, the air blown downwardly from the left air blow groove 23 and the right air blow groove 24 could achieve the guidance effect more effectively.

Therefore, the present invention has following advantages:

1. The present invention provides a left and a right deflection plates that are respectively disposed at the front end of the left and right upright plates. Thereby, it is able to keep the large recirculation bubble that enters into the space below the air-extraction hood away from the front edge of the side plates nearby, so as to prevent the airflow from flowing backward along the original entrance path, and thus prevent the leakage of soot pollutants.
2. The present invention provides a left and a right deflection plates at the front end of the left and the right upright plates and a left and a right top plates in the upper part of an free end of the left and the right deflection plates, and provides the bottom of the air-extraction hood with a left and a right air blow grooves. Thereby, it is able to prevent effectively the three dimensional vortexes and strong turbulences that are produced at the cross of the flange and the side plate of the conventional soot-exhausting device. Moreover, it is also able to keep the vortexes away from the opening at the front end of the soot-exhausting device and guided into the air-extraction slot, so as to prevent effectively the leakage of soot pollutants along the original entrance path.

As disclosed in the above description and attached drawings, the present invention can provide a soot-exhausting device, which can effectively reduce the dispersion of soot pollutants. It is new and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A soot-exhausting device, comprising an air-extraction hood, a left upright plate and a right upright plate, where a bottom of the air-extraction hood is provided with at least one air-extraction slot and the air-extraction slot is connected to an air-extraction device for drawing air upwards; the left upright plate and the right upright plate are respectively placed below a left side and a right side of the air-extraction hood; and a space is formed between the air-extraction hood, the left upright plate and the right upright plate; wherein a side or a surface of the air-extraction hood, the left upright plate and the right upright plate that is approaching towards a user is defined as a front end, while a side or a surface of the air-extraction hood, the left upright plate and the right upright plate that is away from the user in an opposite direction is defined as a rear end; and two sides of the air-extraction hood, the left upright plate and the right upright plate are respectively defined as a left side and a right side when the user faces the air-extraction hood, left upright plate and right upright plate; the soot-exhausting device comprising:

a left deflection plate, extend right-backwardly from a front end of the left upright plate, where the left deflection plate is vertically located in the space; a first included angle is formed between the left deflection plate and the left upright plate; and a side of the left deflection plate that is away from the front end of the left upright plate is defined as a free end of the left deflection plate;

a right deflection plate, extended left-backwardly from a front end of the right upright plate, where the right deflection plate is vertically located in the space; a second included angle is formed between the right deflection plate and the right upright plate; and a side of the right deflection plate that is away from the front end of the right upright plate is defined as a free end of the right deflection plate;

a left top plate and a right top plate, where the left top plate is extended rightwardly from an upper part of the free end of the left deflection plate in a direction away from the left upright plate; the right top plate is extended leftwardly from an upper part of the free end of the right deflection plate in a direction of being away from the right upright plate; and the right top plate and the left top plate have a first spacing therein-between;

a left air blow groove and a right air blow groove, provided on the bottom of the air-extraction hood, where the left air blow groove and the right air blow groove are respectively in elongate shape and blow air downwardly; the left air blow groove is parallel to a top side of the left top plate and located at the rear end of the top side of the left top plate; the right air blow groove is parallel to a top side of the right top plate and located at the rear end of the top side of the right top plate; and the left air blow groove and the right air blow groove are aligned and have a second spacing therein-between; and the distance of the second spacing is shorter than the distance of the first spacing; and a first upright plate and a second upright plate, where the first upright plate is extended leftwardly from the front end of the left upright plate, and the second upright plate is extended rightwardly from the front end of the right upright plate.

2. The soot-exhausting device as claimed in claim 1, wherein the first included angle faces backwardly, and the first included angle is between 20 degrees to 70 degrees.

3. The soot-exhausting device as claimed in claim 2, further comprising a first guiding plate, and the first guiding plate is bended leftwardly from the free end of the left deflection plate in a direction of approaching towards the left upright plate.

4. The soot-exhausting device as claimed in claim 1, wherein the second included angle faces backwardly, and the second included angle is between 20 degrees to 70 degrees.

5. The soot-exhausting device as claimed in claim 4, further comprising a second guiding plate, where the second guiding plate is bended rightwardly from the free end of the right deflection plate in a direction of approaching towards the right upright plate.

6. The soot-exhausting device as claimed in claim 1, wherein the left top plate and the right top plate are symmetrical to each other, and the left top plate has one end that is extended rightwardly while not exceeds the air-extraction slot's left edge, and the right top plate has one end that is extended leftwardly while not exceeds the air-extraction slot's right edge.

7. The soot-exhausting device as claimed in claim 1, wherein the left top plate is an inverted triangle plate.

8. The soot-exhausting device as claimed in claim 1, wherein the right top plate is an inverted triangle plate.

* * * * *